United States Patent [19]

Rogers

[11] Patent Number: 4,911,671

[45] Date of Patent: Mar. 27, 1990

[54] NOVELTY KIT AND METHOD FOR USING IT TO RELIEVE TENSION AND STRESS

[75] Inventor: Buddy L. Rogers, Laguna Hills, Calif.

[73] Assignee: Thumb Thing Fun & Associates, Escondido, Calif. ; a part interest

[21] Appl. No.: 189,965

[22] Filed: May 4, 1988

[51] Int. Cl.[4] ..... A63H 33/28

[52] U.S. Cl. ..... 446/81; 446/24; 446/397; 428/178

[58] Field of Search ..... 446/24, 81, 397; 40/427; 428/178, 166; 206/461; 272/1 R, 8 N

[56] References Cited

U.S. PATENT DOCUMENTS 4,378,391 3/1983 Allen ..... 40/427 X

FOREIGN PATENT DOCUMENTS 377527 6/1964 Switzerland ..... 428/178 U X

*Primary Examiner*—Robert A. Hafer
*Assistant Examiner*—Jam Rimell
*Attorney, Agent, or Firm*—Bernard L. Kleinke; Walter Patrick Waters; Jerry R. Potts

[57] ABSTRACT

A method and kit for helping relieve tension and stress includes inflatable cellular assemblies, which are either configured in the shape of a desired design, or bears markings in the shape of a desired design. A mallet is used for striking the individual cell chambers so as to explode said cells with sound producing force thereby releasing the gaseous contents of the chamber, the sound and gaseous contents further stimulating the user's physical senses to produce humor and amusement whereby the user's tension and stress is relieved.

18 Claims, 3 Drawing Sheets

NOVELTY KIT AND METHOD FOR USING IT TO RELIEVE TENSION AND STRESS

TECHNICAL FIELD

The present invention relates in general to a novelty item kit and a method of using it, and more particularly relates to a kit and method for using the kit to relieve tension and stress.

BACKGROUND ART

Novelty items, such as games, puzzles, and various mechanical contrivances have long been popular purchased items amongst executives and other professionals for the purpose of relieving tension, stress and hostility. However, there are many other people in our society, apart from executives and professionals, whose daily job-related activities are anxiety producing.

For example, commuting on heavily congested highways not only can produce stress and tension, but also can lead to extreme hostile behavior that can endanger life. As another example, consider the unique stress and tension that a modern homemaker must face in managing a household, directing the activities of children and meeting the companion needs of a spouse. From the foregoing, it should be clear that daily stress in modern life, is not limited to business executives, but cuts across the entire spectrum of our society.

Therefore, it would be highly desirable to have a new and improved novelty kit and method of using a kit for helping relieve stress, tension, and hostility. Such a kit should be easy to use, and appeal to a wide variety of people, including the pressured executive or professional, the over-burdened homemaker, and the weary highway commuter.

Because stress and tension can also result in both mental and physical strain, there have been a wide variety of techniques for relieving stress. For example, movies, entertainment activities, music, and sports are but a few of the many ways society has employed to relieve stress and tension. However, such activities are usually expensive and require a special setting and/or special equipment to achieve the desired results.

Therefore, it would be highly desirable to have a novelty kit which can be used to help relieve stress and tension, and which can be used in almost any location, even while traveling in an automobile. Also, such a kit should be relatively inexpensive to manufacture, so that a large number of people can afford to purchase the kit and obtain its beneficial results from its use.

It is also known that amusement activities which keep a person pleasantly and enjoyably occupied, and which cause laughter, aid in relieving tension and stress, because laughter serves to divert a person's attention from more serious thoughts and worry. In this regard, it would also be highly desirable to have a novelty item, which is laughter provoking, and would be both pleasant and enjoyable to use. It should appeal to a wide variety of a person's physical senses of sight, smell, sound and touch, so that stress and tension can be more easily relieved. In this regard, by appealing to more than one sense of the user, a more effective and efficient impact can be made on the mind, where the source of the anxiety resides.

DISCLOSURE OF INVENTION

Therefore, it is the principal object of the present invention to provide a new and improved novelty kit and method of using it, to aid in the relief of tension, stress and hostility.

Another object of the present invention is to provide such a novelty item, which can be used by a person in almost any location, appeals to a wide variety of people, and would be relatively inexpensive to manufacture and easy to use.

Another object of the present invention is to provide such a kit which tends to invade several of a person's physical senses, in such a manner that such a kit may cause amusement and may provoke laughter, to help further relieve tension and stress of the user.

Briefly, the above and further objects of the present invention are realized by providing a method of helping relieve tension, stress and hostility in a safe and amusing manner, and includes a kit to help facilitate the process.

The kit includes an inflated thermoplastic cellular assembly, which includes one face having a series of individual gas-filled cell chambers composed of film material, and the other face being substantially planar or flat. An indicia is disposed on the flat surface, configured in the shape of a design, such as a neck tie or other novelty design, for amusement purposes. The kit further includes a tool for exploding selectively the individual cells of the assembly. The method of using the kit includes placing the assembly on a firm supporting surface with the flat face engaging it, and then manually and forcibly moving a tool into engagement with individual ones of the cells to compress abruptly against the supporting surface, until the gas pressure on the interior of the cell chamber causes the film material to rupture rapidly or to explode, thereby allowing the gas under pressure to escape from the interior of the selected cell.

Upon impact, the cell explodes, and produces an audible popping or cracking sound. As a result, the tension, stress and hostility of the user may be relieved by reason of the stimulation of the user's physical senses. Also, the physical act of striking the assembly tends to relieve ones' frustrations and anxieties.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
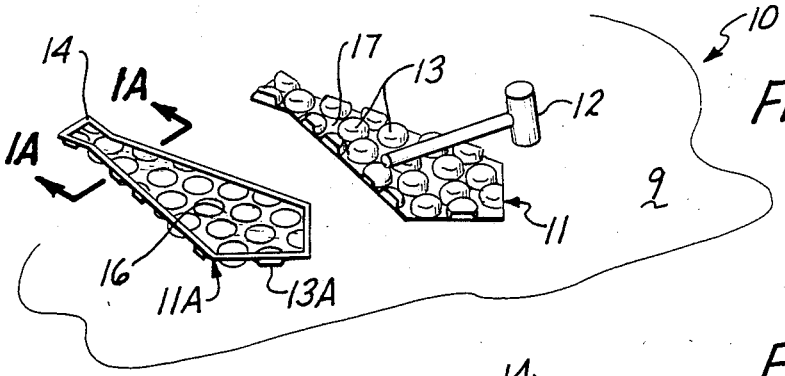
FIG. 1 is a pictorial view, illustrating operative elements of a novelty kit, which is constructed in accordance with the present invention, and which includes a plurality of inflated cellular assemblies.

Referring now to the drawings, and more particularly to FIG. 1 thereof, there is shown a novelty kit 10 which is constructed in accordance with the present invention. The kit 10 is used according to the method of the present invention to help relieve tension and stress, and yet provide an amusing past time. The kit 10 can be used in almost any location, and it is relatively inexpensive to manufacture.

As illustrated in the drawings, and more particularly to FIG. 1, there is shown a novelty kit 10, which generally comprises a mallet 12, and a plurality of similar thermoplastic inflated cellular assemblies, such as the assemblies 11 and 11A disposed in a predetermined base figure configuration, which, as shown in FIG. 1, is in the shape of a neck tie. Thus, the assemblies 11 and 11A are designed to be used by, and marketed to, business executives.

Each assembly includes a plurality of cell chambers generally indicated at 13 and 13A, which are each filled with a suitable gas under pressure. The gas may be air, colored smoke, or a fragrant gas.

Each one of the assemblies are similar to one another. The assembly 11A will now be described in greater detail.

A decal 14 is affixed to the assembly 11A to impart color and an added contrast to the predetermined base figure configuration of the assembly 11. The mallet 12 is used for striking manually by the user the individual cell chambers 13A of the cellular assembly 11A for exploding them one at a time.

Figure 1A:
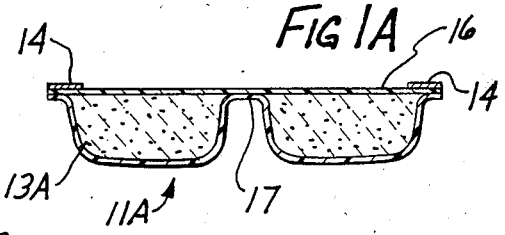
FIG. 1A is a sectional view of on of the assemblies of FIG. 1 taken substantially on line 1A—1A thereof, for illustrating cell chambers.

Considering now the inflated cellular assembly 11A in greater detail with reference to FIG. 1A, the cell chambers of the cellular assembly 11A, is composed of film material, and filled with colored smoke in a similar manner as conventional bubble wrap material, used for packaging purposes. The assembly 11A includes front and back surfaces composed of thin-walled sheets of thermoplastic material. A sheet 16 is generally smooth and flat and is fixed to another sheet 17 by a suitable process to form a plurality of spaced apart hemispherical annular cell chambers affixed sealingly to the sheet 16, as generally shown at 13A. Each individual cell chamber 13A is filled with colored smoke under pressure.

A decal 14 is affixed to the marginal edge of the sheet 16 to impart color and added contrast dimension to the predetermined base figure configuration of the sheet 16. The decal 14 is affixed to sheet 16 by any well known securing technique, such as by applying a suitable adhesive.

The method of relieving tension and stress with the kit 10 will hereinafter be described in greater detail. In operation, the inventive method of using the kit 10 to relieve tension and stress is initiated by a user placing an assembly, such as the assembly 11, on any stationary supporting surface, such as the surface 9, with the individual cell chambers 13 facing downwardly flat against the surface 9.

The user than picks up the mallet 12 and commences striking each individual chamber cell 13 to rupture them abruptly with a resounding popping or cracking sound. By selectively striking with sufficient force individual cell chambers 13 with the mallet 12, the volume area within the chamber is reduced abruptly, so as to increase the interior pressure of the gas contained in the selected cell chamber to a sufficient pressure to rupture the sheet 17 of the thermoplastic film material, thereby allowing the rapid egress of the gas under pressure from the interior thereof. Thus, the resulting explosion produces an accompanying sound, due to the sound producing force delivered to the cell.

As each cell is struck thereafter seriatim, as desired, each one explodes with sound producing force, thereby releasing the air or other inert sense stimulating contents within the cell chamber to the atmosphere. The act of striking the assembly 11 releases the user's hostility in a non-harmful manner, while the produced sound with sense stimulating cells contents continues to amuse the user thereby helping to relieve the user's stress and tension.

Figure 2A:
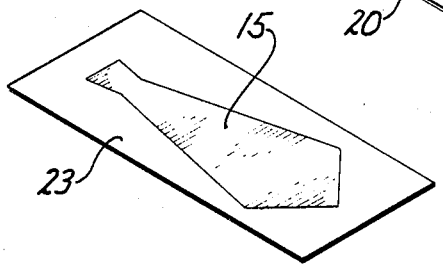
FIGS. 2 and 2A are pictorial views of successive steps in the method of making another thermoplastic inflated cellular assembly of the present invention.
Figure 2:
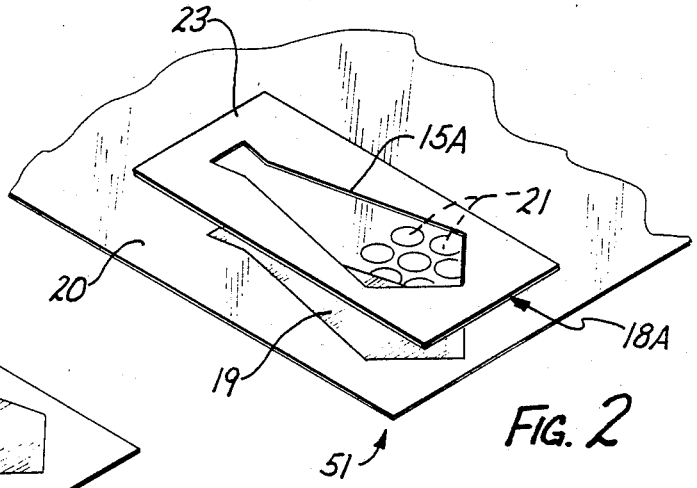

As shown in FIGS. 2, there is shown another cellular assembly 51, which is also constructed according to the present invention, and which forms a part of a kit (not shown) in a similar manner as the kit 10. The assembly 51 is similar in construction to the assemblies 11 and 11A.

The method of making the individual inflated cellular assembly 51 useful in relieving stress and tension is illustrated in FIGS. 2 and 2A. Considering now the initial step of making the inflated cellular assembly 51 with reference to FIG. 2A, the inventive method is initiated by preparing a predetermined base figure design, such as an outline of a neck tie, by imparting a marking impermeable material 15 such as ink or paint, on a sheet of silk 23 or other fine woven fabric material or the like material, which has previously been rendered impermeable. After the marking material 15 has dried, the imparted material 15 is removed from the silk 23 by cutting out the figure outlined by the material 15 leaving a neck tie shaped opening 15A (FIG. 2). In this manner, a stencil 18A as shown in FIG. 2 is formed.

Stencil or template 18A is then superimposed over a flat base sheet 20 of gas filled cells 21 on the opposite side thereof. The assembly 51 is similar in construction to the assemblies 11 and 11A, and is composed of thermoplastic film material, as illustrated in FIG. 2A. A marking material 19 is then imparted to the entire area defined by the stencil 18A so the impermeable material 23 prevents all portions of the design not to be imparted to the thermoplastic sheet, thereby imparting the marking material 19 to the base sheet 16 in a predetermined configuration 21 as shown in FIG. 2. The sheet 16 can then be cut to any desired shape, such as a rectangular shape.

Figure 3:
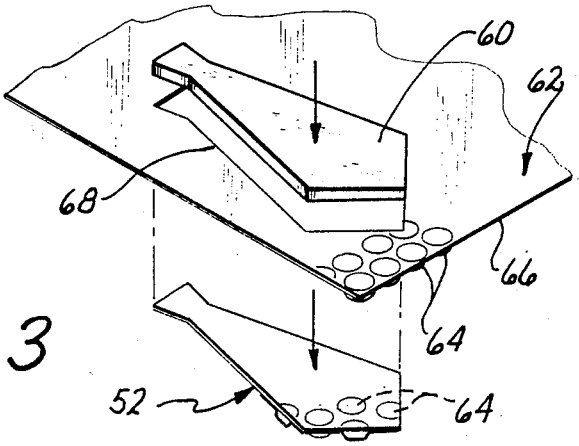
FIG. 3 is a pictorial view of a further inflated cellular assembly, which is also constructed according to the present invention.

Referring now to FIG. 3, there is shown another inflated cellular assembly 52, which is constructed according to the present invention. The assembly 52 is generally similar to the assemblies 11 and 11A, and is configured in the shape of a neck tie.

The assembly 52 is made by forcing a cutting mold or die 60, configured in the shape of a neck tie, into cutting engagement with a sheet 62 of cellular material. The sheet 62 has a series of spaced apart hemispherical gas-filled cells 64 on the back side 66 thereof. A neck tie shaped opening 68 in the sheet 62 is left therebehind, as the completed assembly 52 drops under the force of gravity therefrom.

Figure 4:
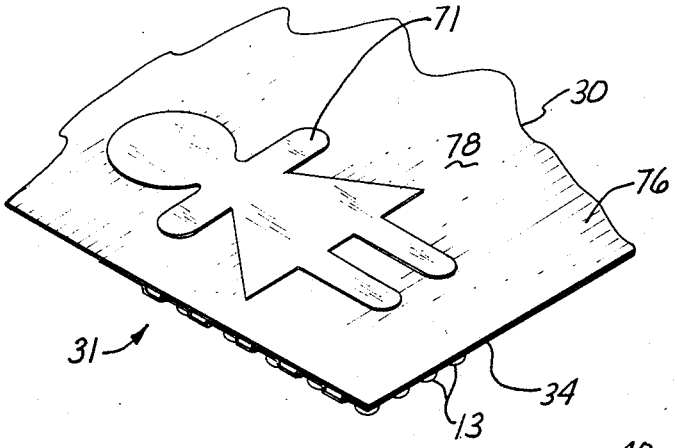
FIG. 4 is a pictorial view of another inflated cellular assembly, which is also constructed in accordance with the present invention.

Referring now to FIG. 4, there is shown another method of making an inflated cellular assembly 31, which is also constructed according to the present invention, and which is generally similar to the assembly 52, except the assembly 31 is configured in the shape of a woman.

Considering now the initial step of making the assembly 31 with reference to FIG. 4, the inventive method is initiated by imparting colored marking material 71 to a flat surface of a sheet 76 having inflated cells 73 on the back side thereof, to form a base figure configuration of the desired shape of a female form.

It is understood that the inflated cellular thermoplastic material 30 has two thin-walled overlying sheets 76 and 34 of thermoplastic. One sheet 76 is substantially flat, and the other sheet 34 is molded to form the plurality of annular cell chambers 73 disposed thereon.

The marking material 71 is then dried. The remaining surface 78 of the sheet 76 is coated with a contrasting color coating to make the marking material 71 configured in the desired shape, to be readily apparent.

Figure 5:
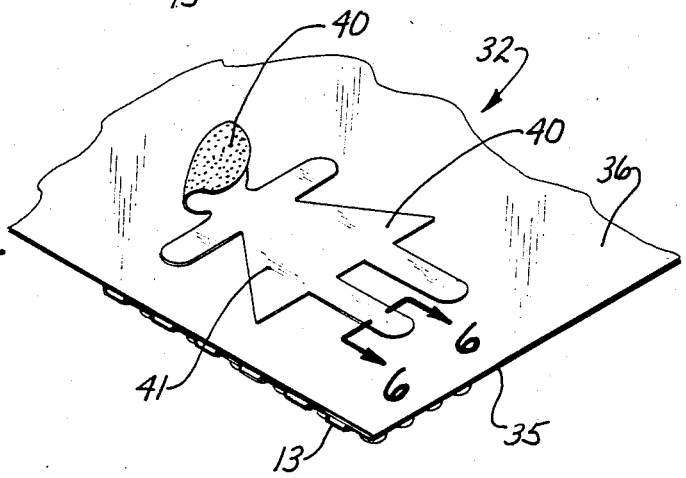
FIG. 5 is a pictorial view of yet another inflated cellular assembly, which is also constructed in accordance with the present invention.
Figure 6:
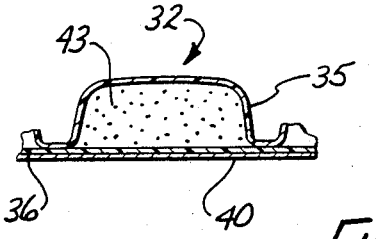
FIG. 6 is a sectional view of the assembly of FIG. 5 taken substantially on line 6—6 thereof, for illustrating a cell chamber.

The method of making an individual cellular assembly 32 useful in relieving stress and tension is illustrated in FIGS. 5 and 6. Considering now the initial step of making the assembly 32 with reference to FIG. 5 the inventive method is initiated by adhering a decal sticker 40 of a predetermined base figure configuration to a flat surface 36 of an inflated cellular thermoplastic material, by any suitable adhesive.

Figure 7:
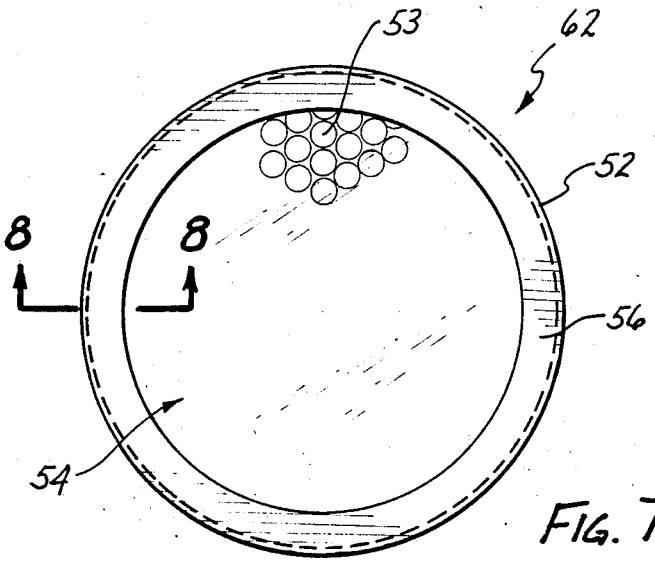
FIG. 7 is a pictorial view of a further inflated cellular assembly, which is also constructed according to the present invention.
Figure 8:
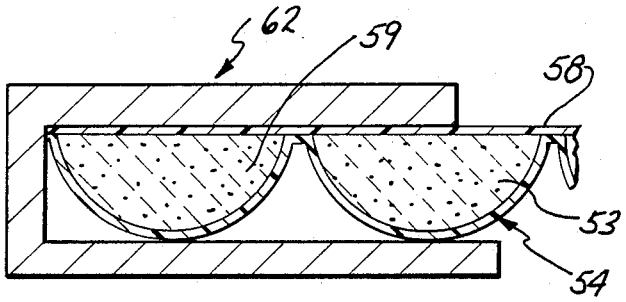
FIG. 8 is a sectional view of the assembly of FIG. 7 taken substantially on line 8—8 thereof, for illustrating a cell chamber.

Another form of an individual cellular assembly 62 is shown in FIGS. 6, 7 and 8. In this construction, the inflated cellular assembly 32 includes a plurality of cellular chambers B filled with smoke or a fragrant gas generally shown at 43 in FIG. 6.

The inflated cellular assembly 32 is placed with its flat surface 36 facing upwardly and an adhesive backed decal 40 is imparted to the surface 36. After the decal 40 is adhered to the surface 36, the thermoplastic material is cut at a distance from the decal 40 to form any desired overall configuration, such as a rectangular shape.

FIGS. 7 and 8 illustrate another inflated cellular assembly 62, which is constructed according to the present invention. The assembly 62 includes an inflated cellular material 54, which has a fibrous border material 52 such as cardboard, at the outer periphery thereof, to serve as a border. The material 52 may be composed of fiberboard.

As shown in FIG. 8, the material 52 is in the form of an annular sheet folded over into a channel shape in cross section throughout its annular configuration for receiving the marginal edge of the material 54 for finishing purposes.

The fibrous material 52 has a predetermined base configuration contoured in the shape of a circle. The inventive method of making the device 62, is initiated by adhering the fibrous border material 52 to the flat surface 58 of inflated cellular thermoplastic material 56, by suitable adhering technique. The inflated cellular thermoplastic material is similar to the material of the assembly 11, and has two sheets composed of thin-walled thermoplastic material. One sheet 58 is substantially flat and molded to another sheet 54, having a plurality of hemispherical cell chambers 53 disposed thereon. Thereafter, the thermoplastic sheet is cut along the circular peripheral edge by a hot wire (not shown).

As shown in FIG. 8, each one of the cell chambers contains a fragrant gas 59 under pressure. Thus, when the chambers are exploded, the fragrant gas is released to the atmosphere for detection by the sense of smell.

Therefore, it should now be apparent that the inflated assemblies are configured in various different shapes, such as outlines of neck ties, women, or generic designs, such as a circle. Each one of the designs could be marketed to different groups of people, such as executives, women, members of the public in general, as well as many others. For example, the assemblies can be configured in the shape of an automobile for people desiring to use them while riding in an automobile or other vehicle.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A novelty item for relieving tension and stress comprising:

an inflated cellular assembly having two thin-walled sheets of thermoplastic material molded together along contiguous oppositely opposed surfaces, said surfaces being the front and rear surfaces of said assembly;

said front surface of said assembly rising upwardly from the oppositely opposed rear surface to define a plurality of annular cell chambers, said rear surface being substantially flat along its entire surface area;

a physical substance bonded to said rear surface, said physical substance being configured in the shape of a contoured design; and wherein said cellular chambers are filled with smoke.

2. A novelty item for relieving tension and stress according to claim 1, wherein said cellular assembly is configured in the shaped contoured design of a contoured design.

3. A novelty item for relieving tension and stress according to claim 1, wherein said physical substance is a marking material.

4. A novelty item for relieving tension and stress according to claim 3, wherein said marking material is ink.

5. A novelty item for relieving tension and stress according to claim 3, wherein said marking material is paint.

6. A novelty item for relieving tension and stress according to claim 1, wherein said physical substance is a decal.

7. A novelty item for relieving tension and stress according to claim 1, wherein said smoke is colored.

8. A novelty item for relieving tension and stress according to claim 1, wherein at least one sheet of said thermoplastic material is colored.

9. A novelty item for relieving tension and stress comprising:

an inflated cellular assembly having two thin-walled sheets of thermoplastic material molded together along contiguous oppositely opposed surfaces, said surfaces being the front and rear surfaces of said assembly;

said front surface of said assembly rising upwardly from the oppositely opposed rear surface to define a plurality of annular cell chambers, said rear surface being substantially flat along its entire surface area;

a physical substance bonded to said rear surface, said physical substance being configured in the shape of a contoured design;

wherein said cellular chamber, are filled with air; and wherein said air includes a fragrance.

10. A kit for relieving tension and stress which comprises:

a plurality of inflated cellular assemblies each of said cellular assemblies having two surfaces, one surface being substantially flat and the other surface having a plurality of annular cell chambers;

means for imparting a substance to said flat surface, said substance being configured in the shape of a contoured design when imparted to said surface;

means for exploding said annular cell chambers with sound producing force allowing the contents thereof to egress to the surrounding atmosphere whereby the act of exploding said annular cell chambers relieves tension and stress;

wherein said annular cell chambers are filled with air; and wherein said air contains a fragrance.

11. A kit according to claim 10 wherein said inflated cellular assembly is configured in the shape of a contoured design.

12. A kit according to claim 10, wherein said substance is a decal.

13. A kit according to claim 10, wherein said substance is paint.

14. A kit according to claim 10, wherein said substance is cardboard.

15. A kit according to claim 10, wherein said inflated cellular assembly comprises a plurality of sheets of thin-walled thermoplastic.

16. A kit according to claim 15 wherein said sheets of thermoplastic are colored.

17. A kit for relieving tension and stress which comprises:

a plurality of inflated cellular assemblies each of said cellular assemblies having two surfaces, one surface being substantially flat and the other surface having a plurality of annular cell chambers;

means for imparting a substance to said flat surface, said substance being configured in the shape of a contoured design when imparted to said surface;

means for exploding said annular cell chambers with sound producing force allowing the contents thereof to egress to the surrounding atmosphere whereby the act of exploding said annular cell chambers relieves tension and stress; and wherein said annular cell chambers are filled with smoke.

18. A kit according to claim 17 wherein said smoke is colored.

* * * * *

UNITED STATES PATENT AND TRADEMARK OFFICE

CERTIFICATE OF CORRECTION

PATENT NO. : 4,911,671

DATED : March 27, 1990

INVENTOR(S) : Buddy L. Rogers

It is certified that error appears in the above-identified patent and that said Letters Patent is hereby corrected as shown below:

Column 2, line 54, after "view of", delete "on", and substitute therefor --one--.

Signed and Sealed this

Twenty-first Day of July, 1992

*Attest:*

DOUGLAS B. COMER

*Attesting Officer*

*Acting Commissioner of Patents and Trademarks*